US007307919B2

(12) United States Patent
Fujisawa

(10) Patent No.: US 7,307,919 B2
(45) Date of Patent: Dec. 11, 2007

(54) RADIO-CONTROLLED TIMEPIECE AND METHOD OF ADJUSTING THE TIME KEPT BY A RADIO-CONTROLLED TIMEPIECE

(75) Inventor: Teruhiko Fujisawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/633,436

(22) Filed: Dec. 5, 2006

(65) Prior Publication Data

US 2007/0140064 A1 Jun. 21, 2007

(30) Foreign Application Priority Data

Dec. 20, 2005 (JP) ..... 2005-366548
Aug. 30, 2006 (JP) ..... 2006-233287

(51) Int. Cl.
*G04C 11/02* (2006.01)

(52) U.S. Cl. ..... 368/47

(58) Field of Classification Search ..... 368/10, 368/46, 47, 49, 52, 55, 60
See application file for complete search history.

(56) References Cited

U.S. PATENT DOCUMENTS 5,297,120 A * 3/1994 Yuzuki et al. ..... 368/47
5,528,560 A * 6/1996 Ogiyama ..... 368/47
6,967,901 B2 * 11/2005 Shimizu ..... 368/47
7,042,808 B2 * 5/2006 Saitoh ..... 368/47
7,075,859 B2 * 7/2006 Miyahara et al. ..... 368/47
7,190,745 B2 * 3/2007 Takada et al. ..... 375/342
2005/0116834 A1 * 6/2005 Block et al. ..... 340/825.21
2005/0259518 A1 11/2005 Saitoh
2006/0067166 A1 * 3/2006 Murata et al. ..... 368/47

FOREIGN PATENT DOCUMENTS

EP 1349021 A 10/2003
JP 2005-315809 A 11/2005

* cited by examiner

*Primary Examiner*—Vit W. Miska
(74) *Attorney, Agent, or Firm*—Global IP Counselors, LLP

(57) ABSTRACT

A radio-controlled timepiece can adjust the time with a short reception process while also reducing the likelihood of incorrect adjustment. The radio-controlled timepiece has a reception control means 31, time information updating means 32, time adjustment storage means 33, and time display means. The reception control means 31 has a simple time adjustment means 330 that is driven within a predetermined time of the last successful signal reception, and a normal time adjustment means 320 that is driven when this predetermined time has passed. The simple time adjustment means 330 has a pulse timing detection unit 331, a offset calculation unit 332, a offset evaluation unit 333, and a seconds information adjustment unit 334. The pulse timing detection unit 331 detects the reference timing, which is the timing of the rising edge or falling edge of rectangular wave pulses in the received time code. The offset calculation unit 332 calculates the difference between this reference timing and the timing of the seconds unit in the internally kept time. The offset evaluation unit 333 determines if this offset is within a tolerance range. The seconds information adjustment unit 334 adjusts the seconds unit of the internal time based on the offset if the offset is within the tolerance range.

7 Claims, 12 Drawing Sheets

RADIO-CONTROLLED TIMEPIECE AND METHOD OF ADJUSTING THE TIME KEPT BY A RADIO-CONTROLLED TIMEPIECE

BACKGROUND

1. Technical Field

The present invention relates to a radio-controlled timepiece and to a method of adjusting the time displayed by a radio-controlled timepiece.

2. Related Art

Radio-controlled timepieces that receive a radio signal containing time information (a longwave standard time signal) and automatically adjust and display the time based on the received time information are known from the literature.

A standard time signal is output, for example, at one second intervals, uses three different pulse widths to indicate the time, and takes one minute to send one complete time code.

Determining the time from these standard time signals typically requires continuously receiving the time signal for several minutes in order to receive the full time code plural times consecutively so that plural time codes can be compared to ensure the accuracy of the received time information. Adjusting the time therefore consumes much time and power.

Addressing this problem, Japanese Unexamined Patent Appl. Pub. 2005-315809 teaches a radio-controlled timepiece that detects the difference between the change in the signal level of the seconds pulse of the standard time signal and the seconds information of the internal timekeeping unit, and adjusts the seconds information of the internal timekeeping unit so that the average of plural difference values goes to zero, thereby enabling adjusting the time without receiving the full time code.

PROBLEM TO BE SOLVED

A problem with the timepiece taught in Japanese Unexamined Patent Appl. Pub. 2005-315809 is that because the time is adjusted based only on the difference between when the pulse level of the standard time signal changes and the seconds value of the internal clock, it is not possible to determine whether the time kept internally by the timepiece is slow or fast compared with the real time.

As a result, when the seconds information of the internal time is adjusted based solely on this difference, the time may not be adjusted correctly to the actual time.

An object of the present invention is therefore to provide a radio-controlled timepiece and a time adjustment method for a radio-controlled timepiece that can adjust the time based on signals received in a short period of time while also reducing the possibility of incorrect adjustments.

SUMMARY

A radio-controlled timepiece according to a preferred aspect of the invention has a reception means for receiving time information modulated by rectangular wave pulses; a reception control means for controlling driving the reception means based on a preset schedule; a time information updating means for updating internal time information based on the time information received by the reception means; a time adjustment storage means for storing how much the internal time information was adjusted by the time information updating means; and a time display means for displaying the time based on the internal time information. The rectangular wave pulses have a rising edge or falling edge occurring at a one-second interval and have a pulse width that when measured from a reference timing that is the timing of the rising edge or falling edge of a pulse to the falling edge of a pulse that rose or the rising edge of a pulse that fell is less than the one-second interval and is one of a plurality of lengths. The reception control means has a simple time adjustment means that is driven when the reception means is driven within a predetermined time of the last successful signal reception, and a normal time adjustment means that is driven when the reception means is driven after the predetermined time since the last successful signal reception. The normal time adjustment means drives the reception means for the time required to receive a full time code, and adjusts the internal time information by means of the time information updating means when time code reception is successful. The simple time adjustment means has a pulse timing detection unit for driving the reception means for a shorter time than when receiving a full time code and detecting the reference timing of the rectangular wave pulses in the time information, an offset calculation unit for calculating the difference between the reference timing of the rectangular wave pulses detected by the pulse timing detection unit and the timing of the seconds unit in the internal time information, an offset evaluation unit for determining if the offset calculated by the offset calculation unit is within a tolerance range set based on the previous time adjustment stored in the time adjustment storage means, and a seconds information adjustment unit for adjusting the seconds unit of the internal time information based on the calculated offset when the offset evaluation unit determines the offset is within the tolerance range.

By having a simple time adjustment means in addition to a normal time adjustment mean that receives the full time code of a standard time signal, the invention can execute a reception process for adjusting the time in a short amount of time and thereby reduce power consumption.

More specifically, because the simple time adjustment means corrects the timing of the seconds unit of the internally kept time based on the difference (offset) between the reference timing of the rectangular wave pulses occurring at one-second intervals in the standard time signal and the timing of the second in the internal time, the time can be adjusted with a reception process that lasts long enough to acquire approximately 10 to 30 rectangular wave pulses, that is, approximately 10 to 30 seconds. Compared with adjusting the time by receiving the full time code, a process that normally requires approximately 5 to 10 minutes, the invention can adjust the time with a reception operation requiring little time and can thereby greatly reduce power consumption.

Furthermore, because the offset evaluation unit sets a tolerance range based on the amount of time adjustment stored in the time adjustment storage means, the offset can be detected with good precision.

More specifically, if there is a difference between the reference timing of the rectangular wave pulses at a one-second interval in the standard time signal and the seconds unit of the internally kept time, [the related art] cannot determine whether the internal time is slow or fast.

The invention therefore focuses on the normal tendency of any offset in the internal time kept by the radio-controlled timepiece to always be in the same direction, sets a tolerance range based on the amount the time was adjusted the last time the time code signal was successfully received, and can thereby determine whether the direction in which the offset occurs is advanced or delayed relative to the received time code. The invention can thus correctly determine the offset in the internal time and can correctly adjust the internal time.

The rectangular wave pulses are either pulses of which the signal level rises from LOW to HIGH at a 1-second interval (1-second period) or pulses of which the signal level falls from HIGH to LOW at a 1-second interval (1-second period), and whether the edge of interest rises or falls can be determined from the type of standard time signal that is received or the arrangement of the reception circuit when the time code is received in a standard time signal. Whether the timing of rising edges coming at a 1-second interval is used as the reference timing or the timing of falling edges coming at a 1-second interval is used as the reference timing can therefore be determined according to which type of rectangular wave pulses are carried in the received signal. The pulse width of the rectangular wave pulses is one of the three types denoting a "1," "0," or "P" in a standard time signal.

Preferably, the simple time adjustment means drives the normal time adjustment means to receive a full time code when the offset evaluation unit determines the offset is outside the tolerance range.

When the offset evaluation unit determines the offset is outside the tolerance range, adjusting the time can be skipped and delayed until the next time the time signal is received. However, if the internal time differs greatly and the offset is outside the tolerance range, the radio-controlled timepiece may continue to display the incorrect time until the next reception process.

To avoid this and reliably adjust the time to the correct time, the invention receives the full time code when the offset is outside the tolerance range and adjusts the time based on the full time code.

Further preferably, the time adjustment storage means stores the time adjustment as a positive value when the internal time information is advanced for adjustment, and stores the time adjustment as a negative value when the internal time information is delayed for adjustment; and the offset calculation means detects the time from the reference timing (the timing of the rising edge or the falling edge) of the rectangular wave pulse to the timing of the next second in the internal time information as a positive offset value when the time adjustment is positive, and detects the time from the timing of the second in the internal time information to the reference timing of the next rectangular wave pulse as a negative offset value when the time adjustment is negative.

The offset calculation means of the present invention determines whether the internal time was slow or fast the last time the time was adjusted, calculates the time from the reference timing of the rectangular wave pulse to the timing of the next second in the internally kept time as the offset when the internal clock is slow, and calculates the time from the seconds unit of the internally kept time to the reference timing of the next rectangular wave pulse as the offset when the internal clock is fast. The invention can therefore correctly determine the offset and can precisely adjust the second.

Yet further preferably, the reception control means is set to a schedule for driving the reception means at a one-day interval; and the offset evaluation unit converts the time adjustment stored by the time adjustment storage means to a time adjustment per day value, sets the tolerance range to a specific range bracketing this time adjustment per day value, and sets the specific range to less than ±0.5 second.

When reception is scheduled at a one-day interval, the offset calculated by the offset calculation means also denotes the difference occurring in one day, and converting the time adjustment to a daily value therefore makes comparison with the offset easier. Furthermore, if the margin added to determine the tolerance range is ±0.5 second, whether the internal time is fast or slow compared with the standard time signal cannot be determine. The invention therefore sets the specific range used to set the tolerance range to less than 0.5 second so that whether the internal time is fast or slow can be determined.

This specific range must only be less than ±0.5 second, and the actual range can be set as desired. For example, increasing this specific range enables the simple time adjustment means to run the time adjustment process even when the offset is slightly large and therefore increases the effect of reducing power consumption. On the other hand, reducing this specific range can reduce the likelihood of incorrect adjustment but does not afford the desired reduction in power consumption because the simple time adjustment process is not executed when, for example, the temperature difference from the previous day is great and the difference between the internal time and the standard time signal increases. The specific range that is used is therefore set desirably according to such conditions.

Further preferably, the pulse timing detection unit detects a predetermined number of rising edges or falling edges of the rectangular wave pulses and calculates the average timing to set the reference timing of the rectangular wave pulses.

The reference timing of the rectangular wave pulses at 1-second intervals can be precisely detected by this seconds synchronization process.

Yet further preferably, when calculating the average timing the pulse timing detection unit ignores the rising edge or falling edge data of rectangular wave pulses in the received time information when the pulse width is less than a predetermined value.

The pulse widths of the time code are one of plural predetermined lengths, and pulses with a pulse width shorter than the shortest predetermined pulse width can be treated as noise. More precise timing data can therefore be acquired by ignoring the timing data for rising or falling edges of pulses determined to be noise when calculating the reference timing of the rectangular wave pulses.

Another aspect of the invention is a time adjustment method for a radio-controlled timepiece having a reception means for receiving time information modulated by rectangular wave pulses, a reception control means for controlling driving the reception means based on a preset schedule, a time information updating means for updating internal time information based on the time information received by the reception means, a time adjustment storage means for storing how much the internal time information was adjusted by the time information updating means, and a time display means for displaying the time based on the internal time information. The rectangular wave pulses have a rising edge or falling edge occurring at a one-second interval and have a pulse width that when measured from a reference timing that is the timing of the rising edge or falling edge of a pulse to the falling edge of a pulse that rose or the rising edge of a pulse that fell is less than the one-second interval and is one of a plurality of lengths. The reception control method has a simple time adjustment step that executes when the reception means is driven within a predetermined time of the last successful signal reception; and a normal time adjustment step that executes when the reception means is driven after a predetermined time since the last successful signal reception has passed. The normal time adjustment step drives the reception means for the time required to receive a full time code, and adjusts the internal time information by means of the time information updating means when time code reception is successful. The simple time adjustment step has a pulse timing detection step for driving the reception means for a shorter time than when receiving a full time code and detecting the reference timing of the rectangular wave pulses in the time information, an offset calculation step for calculating the offset between the reference timing of the rectangular wave pulses detected by the pulse timing detection step and the timing of seconds in the internal time information, an offset evaluation step for determining if the offset calculated by the offset calculation step is within a tolerance range set based on the previous time adjustment stored in the time adjustment storage means, and a seconds information adjustment step for adjusting the seconds information of the internal time information based on the offset when the offset evaluation step determines the offset is within the tolerance range.

Similarly to the radio-controlled timepiece of the invention, this method of the invention has a simple time adjustment step in addition to a normal time adjustment step that receives the full time code of a standard time signal, and can therefore execute a reception process for adjusting the time in a short amount of time and thereby reduce power consumption.

Furthermore, because the offset evaluation step sets a tolerance range based on the amount of time adjustment stored in the time adjustment storage means, the offset can be detected with good precision and the internal time can be adjusted correctly.

The radio frequency information received by the radio frequency reception means in the invention is preferably a standard time signal containing time information and calendar information.

Standard time signals are longwave signals that are transmitted in countries including Japan, Germany, the United States, and Great Britain, and while the time code is different in different countries the transmission frequencies are the same or within a relatively narrow band. The different time signals can therefore be easily detected by using a single antenna and switching tuning capacitors. A radio-controlled timepiece that can be used in each country can therefore be provided at low cost by providing appropriate tuning capacitors and a program for interpreting the different time codes.

EFFECT OF THE INVENTION

As described above, a radio-controlled timepiece and time adjustment method according to the present invention can adjust the time based on signals received in a short period and can also improve the accuracy of the adjusted time.

Other objects and attainments together with a fuller understanding of the invention will become apparent and appreciated by referring to the following description and claims taken in conjunction with the accompanying drawings.

KEY TO THE FIGURES

Figure 1:
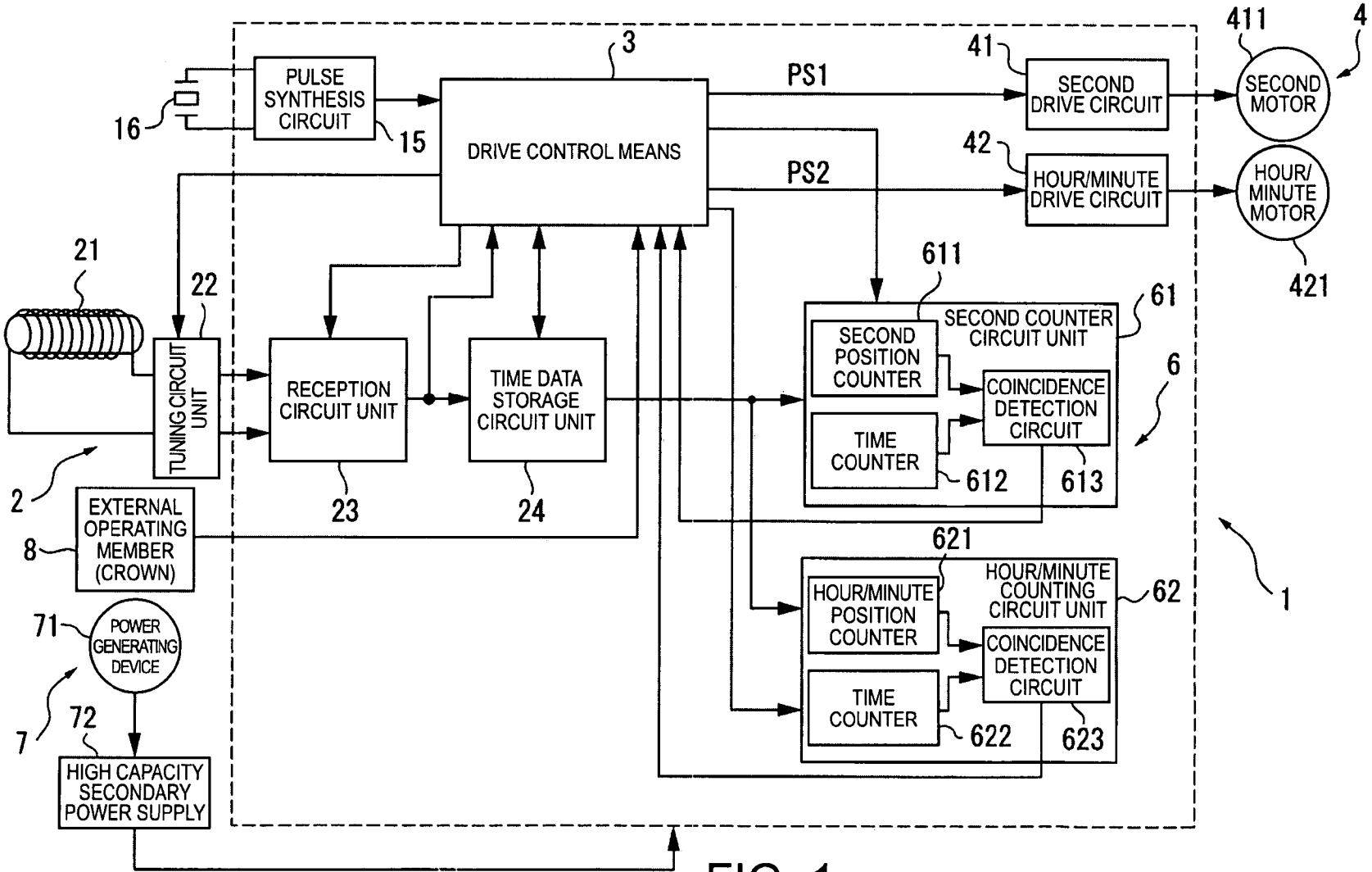
FIG. 1 is a block diagram showing the arrangement of a radio-controlled timepiece according to a first embodiment of the invention.

1 radio-controlled timepiece
2 time signal receiving means
3 drive control means
4 mechanical drive means
6 counter means
7 power supply means
8 external operating member(crown)
21 antenna
23 reception circuit unit
24 time data storage circuit unit
31 reception control means
32 time information updating means
33 time adjustment storage means
35 movement control means
310 reception schedule storage means
320 normal time adjustment means
330 simple time adjustment means
331 pulse timing detection unit
332 offset calculation unit
333 offset evaluation unit
334 seconds information adjustment unit

DESCRIPTION OF EXEMPLARY EMBODIMENTS

Preferred embodiments of the present invention are described below with reference to the accompanying figures.

First Embodiment

FIG. 1 is a block diagram showing the arrangement of a radio-controlled timepiece 1 as an electronic device according to a first embodiment of the invention.

The radio-controlled timepiece 1 of the present invention has the same basic arrangement as a common radio-controlled timepiece, including a time signal receiving means 2 for receiving radio frequency information containing time information (external wireless information), a drive control means 3, a mechanical drive means 4 for driving the hands, a counter means 6 for keeping time, a power supply means 7 for supplying power, and an external operating member 8 such as a crown or button.

The time signal receiving means 2 has an antenna 21, a tuning circuit unit 22 such as a capacitor for tuning to the signal received by the antenna 21, a reception circuit unit 23 for processing information received by the antenna 21, and a time data storage circuit unit 24 for evaluating and storing the time data processed by the reception circuit unit 23.

The antenna 21 has a coil wound to a magnetic core, and is insulated as needed with a cationic electrodeposition coating for excellent corrosion resistance.

The magnetic core is manufactured by die stamping or etching a cobalt-based amorphous foil (such as an amorphous foil of at least 50 wt % cobalt) to shape, laminating and bonding approximately 10 to 30 foil pieces together, and stabilizing the magnetic properties by annealing or other heat treatment process. The magnetic core is not limited to a laminated amorphous foil core and could be a ferrite core, for example. A ferrite core can be made by die stamping and heat treatment, for example.

Figure 2:
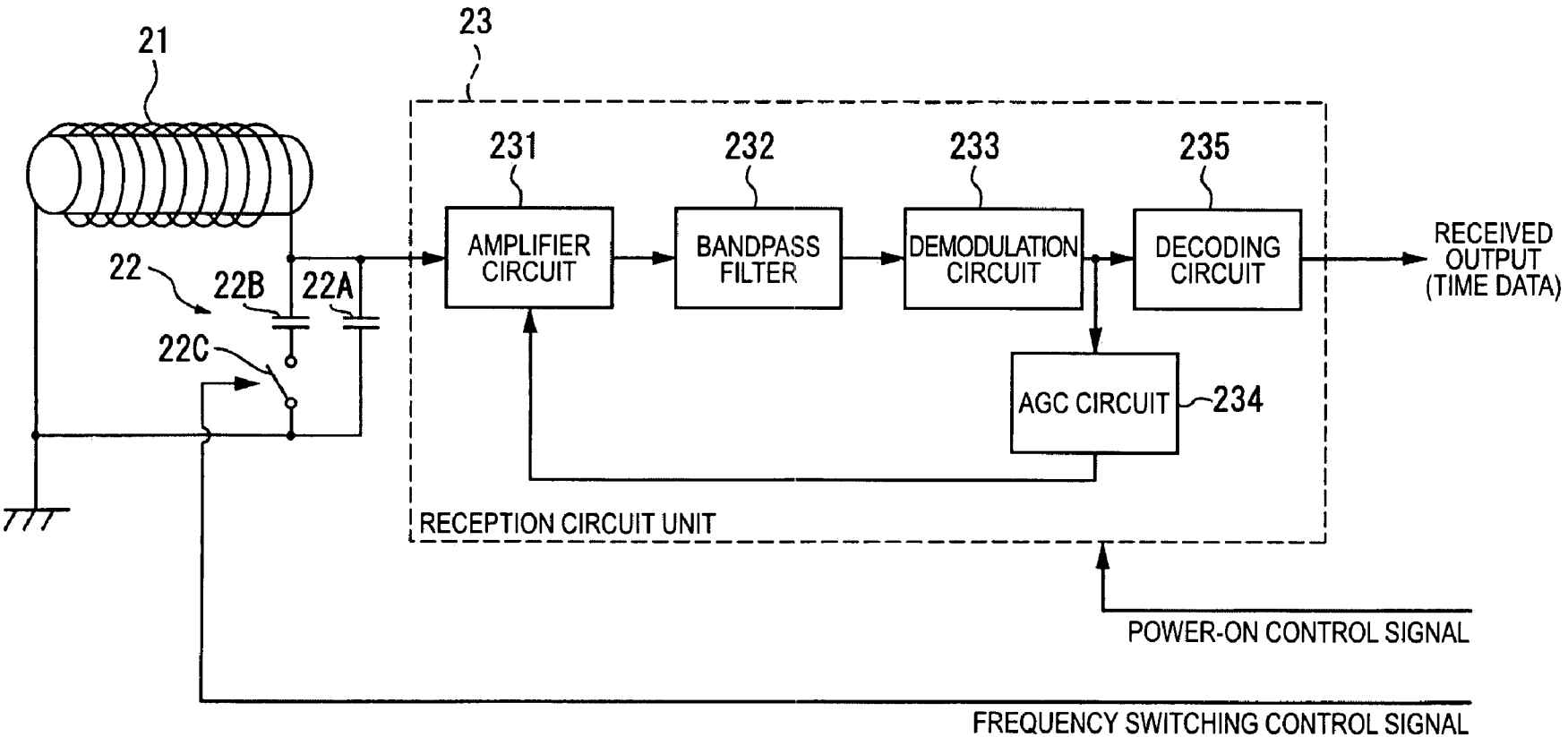
FIG. 2 is a block diagram showing the arrangement of the reception circuit in a first embodiment of the invention.

As shown in FIG. 2, the tuning circuit unit 22 has two capacitors 22A and 22B parallel connected to the antenna 21. One capacitor 22B is connected to the antenna 21 through a switch 22C.

The frequency switching control signal output from the drive control means 3 changes the frequency of the signal received by the antenna 21 by turning this switch 22C on or off.

To change the reception frequency the tuning capacitors 22A and 22B of the frequency switching unit are switched by the switch 22C, which may be a transistor, based on a signal (frequency switching control signal) from the drive control means 3. By switching between two capacitors 22A and 22B, this embodiment of the invention can selectively receive two different frequencies.

This arrangement enables the timepiece to switch and selectively receive longwave standard time signals transmitted on two different frequencies such as the 40-kHz transmission frequency (JJY 40 kHz) and 60-kHz transmission frequency (JJY 60 kHz) that are used in Japan.

Note that if three capacitors are provided the reception frequency can be switched between three different frequencies. Alternatively, three capacitors and two switches can be used to render an arrangement for switching between three or four different frequencies. Further alternatively, a tap can be disposed in the middle of the antenna coil to switch the inductance and thereby selectively receive plural different frequencies.

The standard time signal frequencies used in selected countries around the world are 40 kHz and 60 kHz in Japan (JJY), 77.5 kHz in Germany (DCF77), 60 kHz in Great Britain (MSF), 60 kHz in the United States (WWVB), and 68.5 kHz in China (BPC). As a result, if the timepiece is arranged to enable receiving the four frequencies of 40, 60, 68.5, and 77.5 kHz, standard time signals can be received in each of these countries (regions) and a radio-controlled timepiece 1 that can be used in many different countries can be provided.

The reception circuit unit 23 includes an amplifier circuit 231, bandpass filter 232, demodulation circuit 233, AGC circuit 234, and decoding circuit 235 as shown in FIG. 2. The amplifier circuit 231 amplifies the longwave standard time signal received by the antenna 21. The bandpass filter 232 extracts the desired frequency component from the amplified longwave standard time signal. The demodulation circuit 233 then smoothens the longwave standard time signal. The AGC circuit 234 controls the gain of the amplifier circuit 231 to hold the output longwave standard time signal at a constant signal level. The decoding circuit 235 decodes and outputs the demodulated longwave standard time signal.

The time data that is received and signal processed by the reception circuit unit 23 is output to the time data storage circuit unit 24 as shown in FIG. 1.

The reception circuit unit 23 starts receiving time information based on the power-on control signal or frequency switching control signal output from the drive control means 3 according to a predetermined schedule or when time signal reception is initiated unconditionally using the external operating member.

The time data storage circuit unit 24 determines whether time signal reception succeeded or failed and stores the received data when reception is determined successful.

The reception data evaluation process determines whether the received data is correct or not based on signal output from the reception circuit unit 23, and thus determines whether reception was a success or failure.

Pulse signals from the pulse synthesis circuit 15 are input to the drive control means 3 as shown in FIG. 1. The pulse synthesis circuit 15 frequency divides a reference pulse from a quartz oscillator or other reference oscillator 16 to produce a clock pulse, and also generates pulse signals of different pulse widths and timing from the reference pulse.

Figure 3:
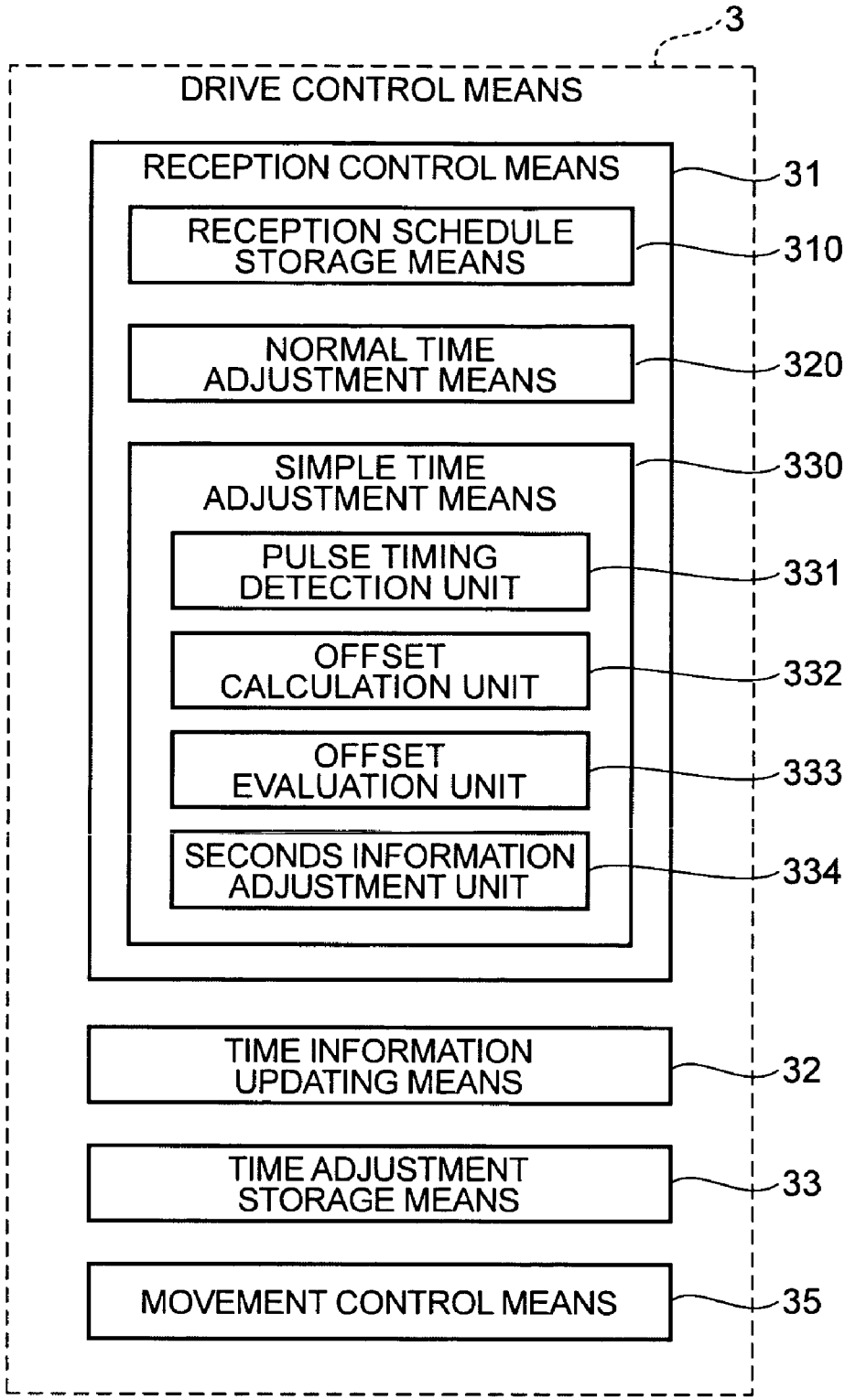
FIG. 3 is a block diagram showing the arrangement of a drive control means in a first embodiment of the invention.

The drive control means 3 has a reception control means 31, time information updating means 32, time adjustment storage means 33, and movement control means 35 as shown in FIG. 3.

The reception control means 31 includes a reception schedule storage means 310, normal time adjustment means 320, and simple time adjustment means 330.

The simple time adjustment means 330 includes a pulse timing detection unit 331, offset calculation unit 332, offset evaluation unit 333, and seconds information adjustment unit 334.

The reception schedule storage means 310 stores the reception schedule of the radio-controlled timepiece 1. The default setting is set to receive once a day at a 24-hour interval. Current consumption during reception is approximately 100 μA, which is approximately 100 times the power consumption when simply displaying the time. As a result, if the radio-controlled timepiece 1 is configured to conserve power by changing the reception interval to once every other day, for example, when the capacity of the power supply means 7 is low, the reception schedule storage means 310 is similarly arranged to store more than one reception schedule.

The normal time adjustment means 320 executes the normal reception process for receiving the complete time code of the standard time signal. The normal time adjustment means 320 therefore normally executes a process acquiring the full time code (time information for one full minute) carried by the longwave standard time signal plural times by receiving the time signal continuously for four to five minutes.

The simple time adjustment means 330 operates when the scheduled reception time is within a predetermined period (which is 24 hours in this embodiment) after the last successful time signal reception.

Therefore, if the reception schedule is set to receive at 24-hour intervals and if reception was successful at the last scheduled reception time, the simple time adjustment means 330 operates at the next scheduled reception (that is, 24 hours later). The normal time adjustment means 320 operates, however, if reception failed at the last scheduled reception time, such as when reception was determined not successful based on the received data stored in the time data storage circuit unit 24 or the simple time adjustment means 330 operated at the previous scheduled reception time and a normal full time code was not received.

The pulse timing detection unit 331 drives the time signal receiving means 2 for less time (such as approximately 10 to 30 seconds) than is required for the normal time adjustment means 320 to receive a full time code, and detects the timing of the rising edge of the rectangular wave pulses in the time code output from the reception circuit unit 23. The signal level of the rectangular wave pulses in the time code is set to rise from LOW to HIGH at a one second interval, and the pulse timing detection unit 331 in this embodiment is therefore set to detect the timing of the rising edge of the rectangular wave pulse (the reference timing).

The offset calculation unit 332 then calculates the offset between the timing of the rising edge of the rectangular wave pulse detected by the pulse timing detection unit 331 and the timing of the second in the internally kept time.

The offset evaluation unit 333 determines if the difference calculated by the offset calculation unit 332 is within a tolerance range set according to the time adjustment value stored in the time adjustment storage means 33.

If the offset evaluation unit 333 determines that the offset is within the tolerance range, the seconds information adjustment unit 334 adjusts the seconds unit of the internally kept time based on this offset.

The time information updating means 32 updates the internal time based on the received time information.

The time adjustment storage means 33 stores the time adjustment when the normal time adjustment means 320 corrects the internal time.

The movement control means 35 controls driving the hands by outputting the seconds drive pulse signal PS1, which is output once a second for driving the second hand, and the hour/minute drive pulse signal PS2, which is output once a minute for driving the hour and minute hands, to the second drive circuit 41 and hour/minute drive circuit 42, respectively. More specifically, the drive circuits 41 and 42 respectively drive a second motor 411 and hour/minute motor 421, which are stepping motors that are driven by means of pulse signals output from the drive circuits 41 and 42, and thereby drive the second hand and the hour and minute hands that are connected to the corresponding motors 411 and 421. The hands, motors 411 and 421, drive circuits 41 and 42, and movement control means 35 together render a time display means for displaying the time. Note that the time display means could drive the hour hand, minute hand, and second hand with one motor.

The counter means 6 includes a second counter circuit unit 61 for counting the seconds, and an hour/minute counting circuit unit 62 for counting the hour and minute.

The second counter circuit unit 61 includes a second position counter 611, seconds time counter 612, and coincidence detection circuit 613. The second position counter 611 and seconds time counter 612 are loop counters that count to 60 and thus loop once every 60 seconds when a 1-Hz signal is input. The second position counter 611 counts the drive pulse signal (seconds drive pulse signal PS1) that is supplied from the drive control means 3 to the second drive circuit 41. The second position counter 611 thus tracks the position indicated by the second hand by counting the drive pulse signal that drives the second hand.

The seconds time counter 612 normally counts the 1-Hz reference pulse signal (clock pulse) output from the drive control means 3. When the time signal receiving means 2 receives time data, the counter is adjusted to the seconds value in the time data.

The hour/minute counting circuit unit 62 similarly includes an hour/minute position counter 621, hour/minute time counter 622, and coincidence detection circuit 623. The hour/minute position counter 621 and hour/minute time counter 622 are counters that loop once when signals for a 24-hour period are input. The hour/minute position counter 621 counts the drive pulse signal (hour/minute drive pulse signal PS2) that is supplied from the drive control means 3 to the hour/minute drive circuit 42, and counts the positions indicated by the hour and minute hands.

The hour/minute time counter 622 normally counts the pulses of a 1-Hz clock pulse output from the drive control means 3 (and more precisely increments the counter 1 each time 60 1-Hz pulses are counted). When the time signal receiving means 2 receives a time code, the counter is corrected to the hour/minute units of the received time code.

The coincidence detection circuits 613 and 623 respectively detect if the counts of the position counters 611 and 621 and the time counters 612 and 622 are the same, and output a detection signal denoting whether the counts match to the drive control means 3.

If a mismatch signal is input from either coincidence detection circuit 613 and 623, the movement control means 35 of the drive control means 3 continues outputting the drive pulse signals PS1 and PS2 until a match signal is input. During normal operation of the movement the counts of the time counters 612 and 622 change at the 1-Hz reference signal from the drive control means 3 and therefore cease to match the position counters 611 and 621. The drive pulse signals PS1 and PS2 are therefore output, causing the hands to move and the position counters 611 and 621 to match the time counters 612 and 622. Normal operation of the movement is controlled by repeating this operation.

When the time counters 612 and 622 are adjusted based on the received time data, the drive pulse signals PS1 and PS2 are output to rapidly advance the hands until the hands indicate the correct time and the counts of the position counters 611 and 621 match the time counters 612 and 622.

The power supply means 7 includes a power generating device 71 and a high capacity secondary power supply 72. The power generating device 71 generates power by means of a self-winding generator or solar cell (solar power generator). The high capacity secondary power supply 72 stores the power generated by the power generating device 71. The high capacity secondary power supply 72 is typically a lithium ion battery or similar secondary cell. Alternatively the power supply means 7 could be a silver battery or other primary cell.

The external operating member 8 is a crown or button, for example, and is used to start the time signal reception operation and adjust the time.

The time code of the standard time signal received by the radio-controlled timepiece 1 conforms to a specific time code format defined for each country.

Figure 4:
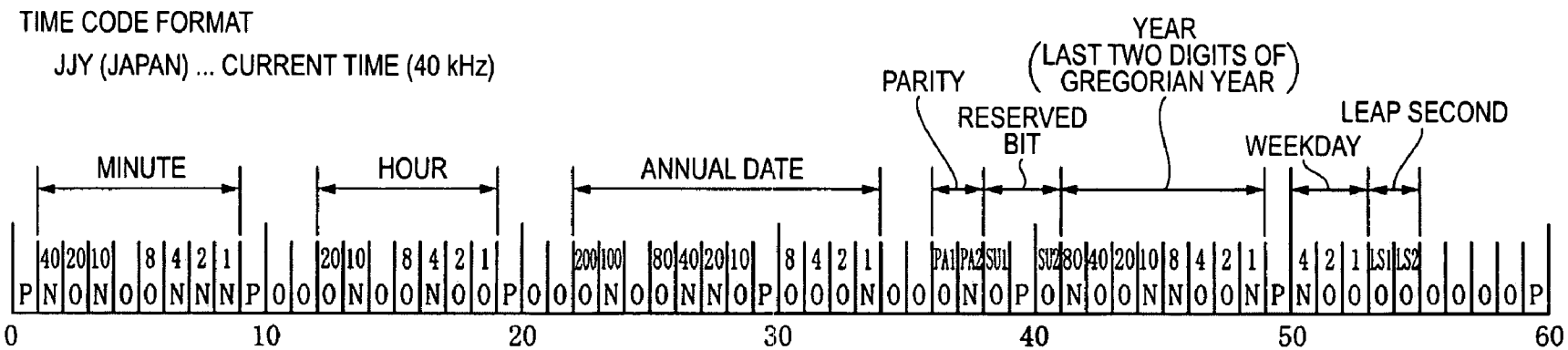
FIG. 4 shows the time code format of a longwave standard time signal (JJY).

The time code format of the JJY standard time signal broadcast in Japan is shown in FIG. 4, transmits one signal every second, and sends one complete time code frame over a period of 60 seconds. One frame therefore contains 60 data bits. Each time code frame includes time information and calendar information. The time information includes the minute and hour of the current time, and the calendar information includes the number of days since January 1 of the current year, the year (the last two digits of the Gregorian year), and the weekday. The value of each data unit is determined by adding the numeric values assigned to each bit (second), and the on/off state of each bit is determined from the signal type.

Figure 5A:
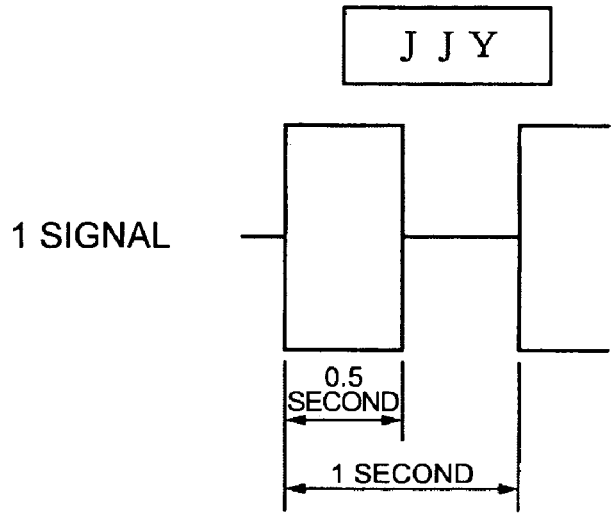
FIG. 5 shows the types of signals in one time code format.
Figure 5B:
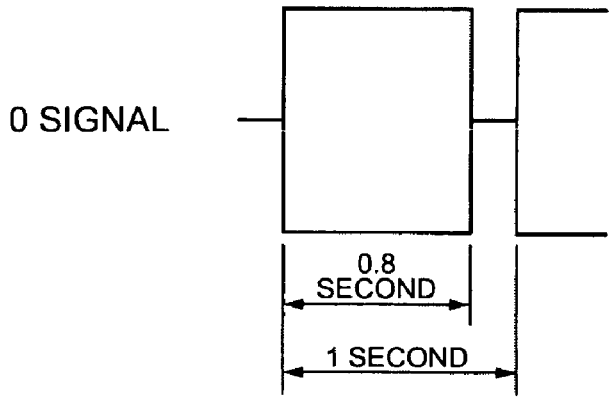
Figure 5C:
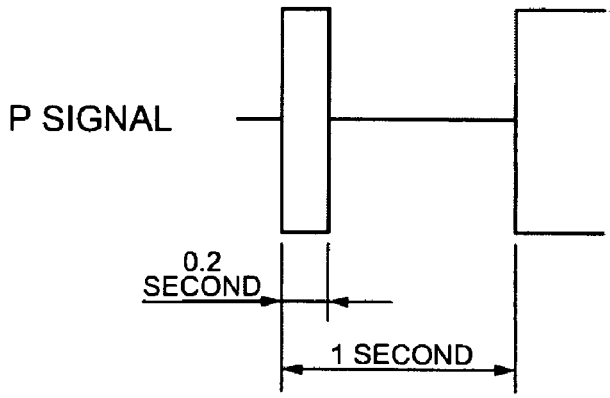

As shown in FIG. 5, three types of signals respectively denoting a 1, 0, or P are sent as part of a longwave standard time signal. These signal types are determined from the length of the amplitude modulation time of each signal. FIG. 5A shows the waveform of a "1" signal, which is recognized as a "1" when the amplitude level is held for 0.5 second from the rising edge of the signal. FIG. 5B shows the waveform of a "0" signal, which is recognized as a "0" when the amplitude level is held for 0.8 second from the rising edge of the signal. FIG. 5C shows the waveform of a "P" signal, which is recognized as a "P" when the amplitude level is held for 0.2 second from the rising edge of the signal.

A "1" signal triggers an ON state and the value of the corresponding bit is accumulated for calculating the hour, minute, or other value. In FIG. 4 the bits denoted "N" in the time code format of the longwave standard time signal indicate bits for which a "1" signal was transmitted.

Any signal other than a "1" signal triggers an OFF state, and the value of the corresponding bit is not used for calculating the hour, minute, or other time information.

For example, if signals transmitted in the 8-second period corresponding to the minute block of this standard time signal are 1, 0, 1, 0, 0, 1, 1, 1, for example, the minute of the current time is known to be 40+10+4+2+1=57. "P" bits in the time code format of the longwave standard time signal are reference bits that are used for synchronizing the transmitted longwave standard time signal with the time code format. The first P bit in the time code format, that is, the second of two consecutive P bits in the time code format, denotes the rising edge of the full minute (the 0 second of every minute), indicates that the second is 00, and indicates that the minute value has changed to the next minute.

It should be noted that because the longwave standard time signal is based on a cesium clock, a radio-controlled timepiece that adjusts the time based on the received longwave standard time signal is highly precise with an error of only one second in more than one-million [100,000, sic] years.

Although not shown in the figure, the time code format of the standard time signal varies according to the country, and the format (data) of the received time code can be used to determine the station that transmitted the standard time signal, or can more specifically determine the type of signal transmitted. While the JJY signal transmitted in Japan, the MSF signal transmitted in Britain, and the WWVB signal transmitted in the United States all use the same 60 kHz frequency, the time code formats differ. As a result, the decoding operation of the decoding circuit 235 that decodes the received data can be controlled according to the station from which the standard time signal was received.

Figure 6A:
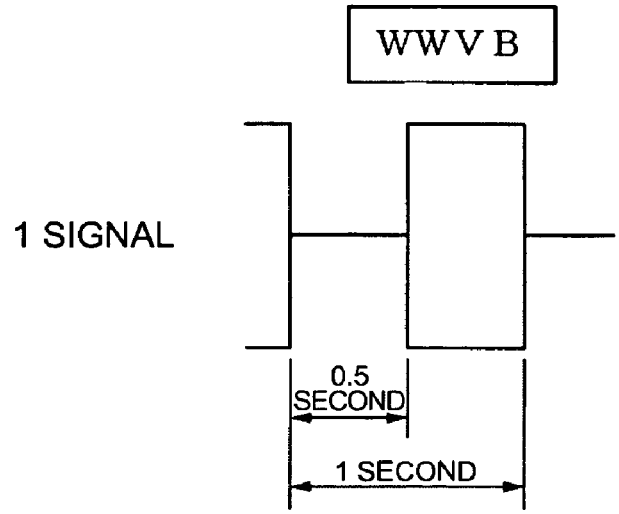
FIG. 6 shows the types of signals in the time code format of another longwave standard time signal (WWVB).
Figure 6B:
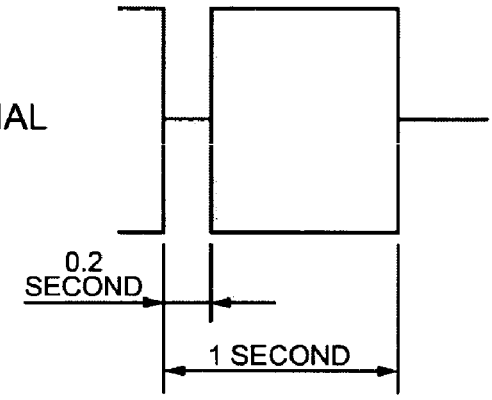
Figure 6C:
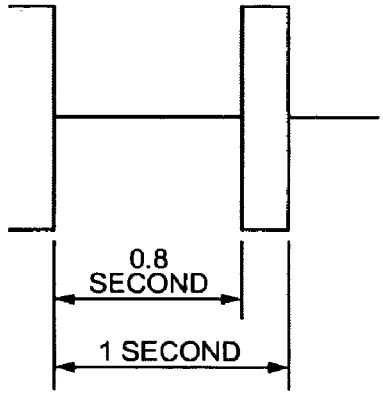

FIG. 5 and FIG. 6 show signals output from the reception circuit unit 23. Each pulse of the JJY signal shown in FIG. 5 is referenced to the timing of the rising edge of the signal, that is, the signal rises at a regular one second interval. Depending on the type of standard time signal, however, the data bits are referenced to the timing of the falling edge of the signal. As shown in FIG. 6, for example, each pulse falls at a one second interval in the WWVB time signal transmitted in the United States, and the falling edge of each pulse is therefore used for the reference timing.

The reception signal that is actually input to the drive control means 3 through the reception circuit unit 23 may be output inverted depending on the configuration of the reception circuit unit 23. In this situation the reference timing for each pulse of the JJY time signal is the falling edge of the signal.

The pulse timing detection unit 331 therefore sets whether the rising edge or falling edge of the pulses is used as the reference timing at which the signal level changes at a one-second interval in the pulse train input from the reception circuit unit 23 for each reception station, and when a station is selected for reception sets whether to detect the rising edge or the falling edge of the pulses according to the selected channel.

More specifically, the pulse timing detection unit 331 must be arranged so that it can detect the timing at which the signal level changes at a 1-second interval in a pulse train in which the signal level changes by rising or falling at a 1-second interval.

The operation of the drive control means 3 in this radio-controlled timepiece 1 is described next with reference to the flow chart in FIG. 7.

The drive control means 3 first determines if the user operated the crown, button, or other external operating member 8 to start the reception operation (step S1).

If the drive control means 3 decides in S1 that reception was not started manually, the drive control means 3 references the reception schedule stored in the reception schedule storage means 310 and determines if the scheduled reception time has been reached (step S2).

If reception was manually initiated in step S1 or the scheduled reception time was reached in step S2, the drive control means 3 starts the reception process (step S3). When the reception process (S3) ends, or if step S2 returns No because it is not the scheduled reception time, the drive control means 3 continues with normal operation of the movement (step S4). The drive control means 3 thus continuously loops through steps S1 to S4.

Figure 7:
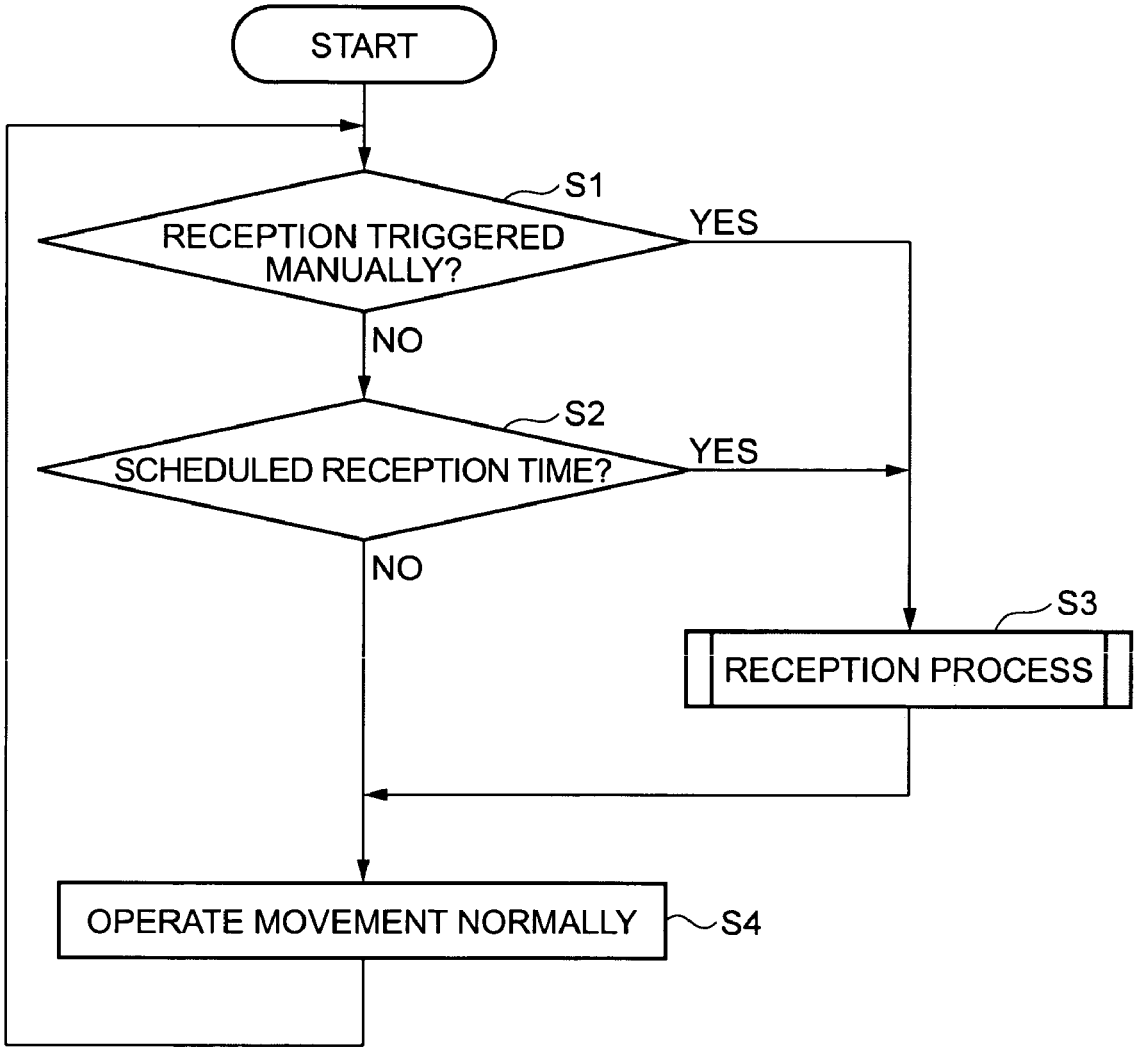
FIG. 7 is a flow chart describing control in the first embodiment of the invention.
Figure 8:
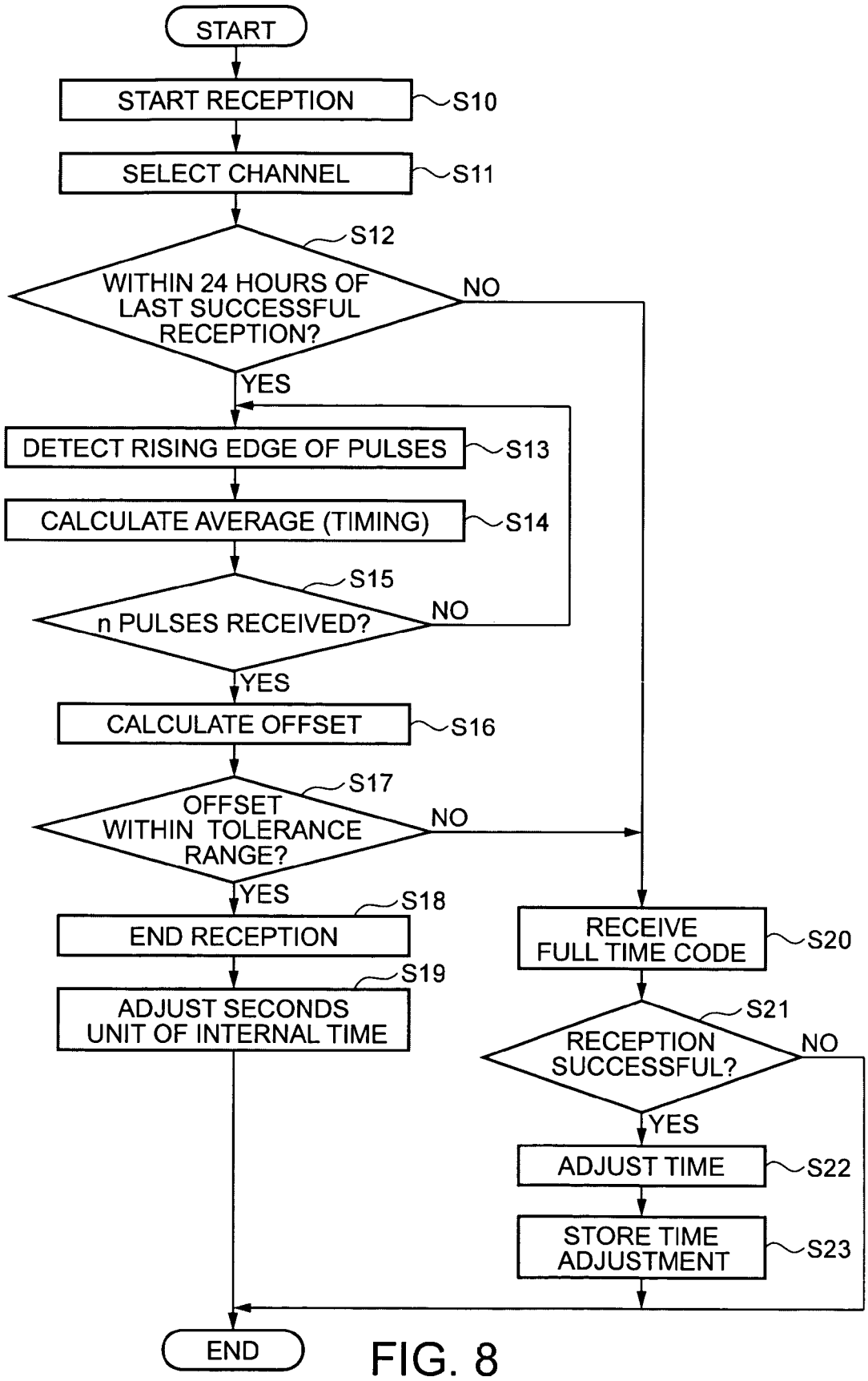
FIG. 8 is a flow chart of the reception process in the first embodiment of the invention.

The reception process that executes in step S3 in FIG. 7 is shown in the flow chart in FIG. 8.

When the drive control means 3 starts the reception process, the drive control means 3 runs a start reception step (S10). When this start reception step S10 executes the movement control means 35 controls the second drive circuit 41 and hour/minute drive circuit 42 to stop driving the motors 411 and 421.

The drive control means 3 also sends signals to the tuning circuit unit 22 and reception circuit unit 23 to drive the reception circuit and execute a channel selection step (S11). More specifically, the tuning circuit unit 22 switches the tuning frequency and the settings of the decoding circuit 235 are changed according to the selected reception channel.

Note that the motors are stopped to prevent magnetic noise emitted from the motor coil from entering the reception antenna and interfering with signal reception.

The reception control means 31 determines if the current time is within 24 hours of the last successful reception (S12). The reception schedule normally stored in the reception schedule storage means 310 schedules reception at a predetermined time such as at 2:00 a.m. every day.

This embodiment of the invention assumes by way of example that the reception process starts every day at 2:00 a.m. From five to ten minutes are required to successfully receive a full time code, and the time at which reception succeeds is therefore from approximately 2:05 to 2:10 a.m. As a result, if reception was successful the day before, the current time will be less than 24 hours since the last successful reception, and step S12 returns Yes.

However, if reception failed on the previous day or a full time code frame was not received as further described below, more than 24 hours will have passed since the last successful reception, and step S12 therefore returns No.

If S12 returns Yes, the pulse timing detection unit 331 of the simple time adjustment means 330 operates and the timing of the rising edge of the rectangular wave pulse (time code) output from the reception circuit unit 23 is detected (S13).

Figures 9A, 9B:
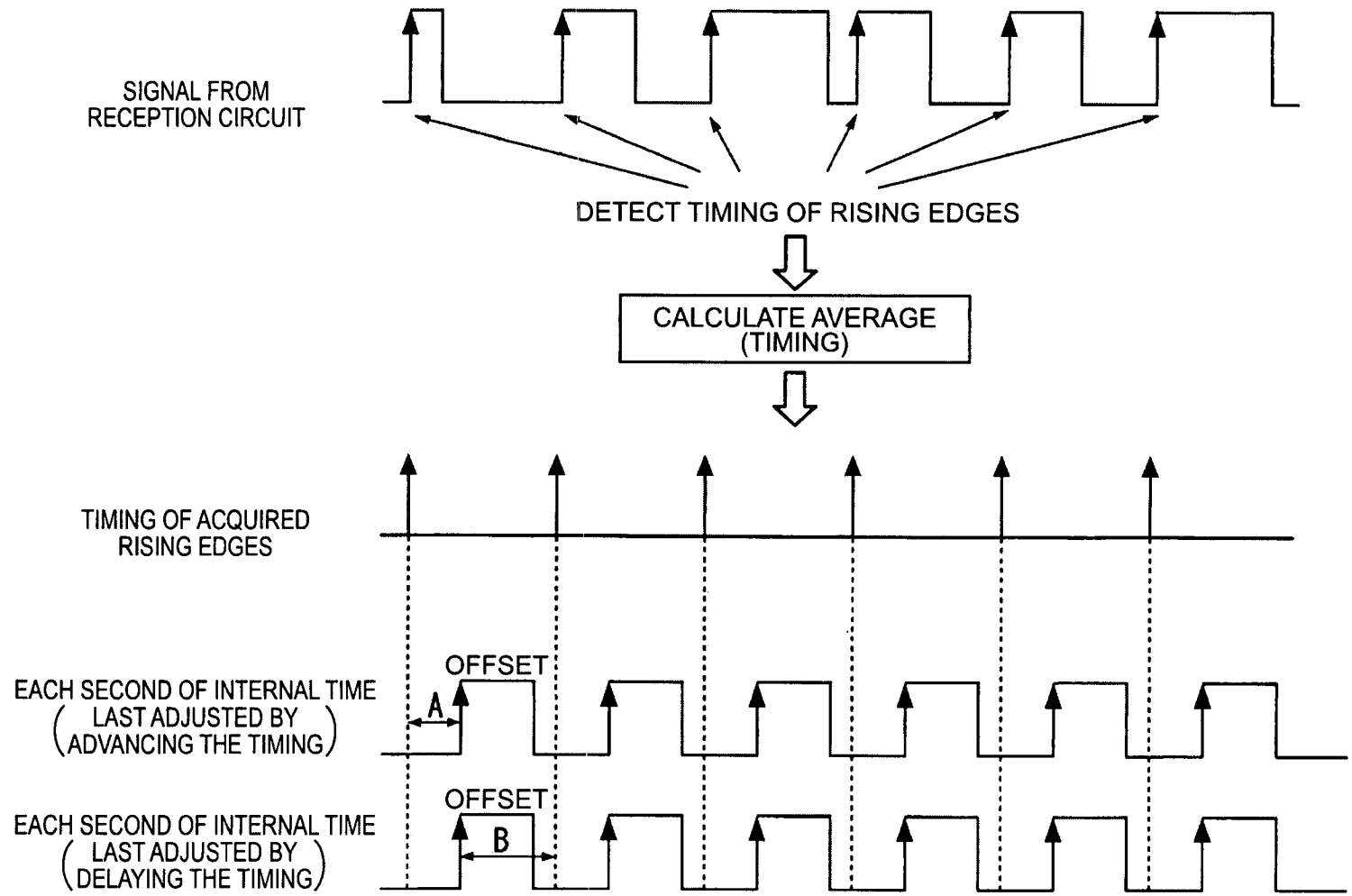
FIG. 9 describes the process for detecting the rising edge timing and calculating the offset in a first embodiment of the invention.

The rising edge of the rectangular wave pulses occurs at one-second intervals, but if reception conditions are poor and the S/N ratio is low, the timing of the rising edges of the rectangular wave pulses may vary. When detecting the rising edges as shown in FIG. 9A (S13), the pulse timing detection unit 331 in this embodiment therefore obtains the average of the detected values (S14). Whether a predetermined number (n) of rising edges have been detected is then determined (S15). If not (S15 returns No), the rising edge timing detection step (S13) and averaging step (S14) repeat.

If step S15 returns Yes, the offset calculation unit 332 compares the rising edge timing acquired by the pulse timing detection unit 331 with the timing of the full second (each second) of the internal time, and calculates the offset (S16).

The offset calculation unit 332 calculates this offset according to the value of the previous time adjustment stored in the time adjustment storage means 33.

More specifically, if the previous time adjustment was +0.6 second, meaning that the internal time was advanced 0.6 second for adjustment, the likelihood that the internal time is again later than the reference time of the standard time signal is high. As a result, the offset calculation unit 332 sets the offset to the time difference B from the rising edge of the rectangular wave pulse to the rising edge of the previous second of the internal time.

The pulse signal output each second from the coincidence detection circuit 613 of the second counter circuit unit 61 can be used for the full second (each second) of the internal time, or the reference signal output each second from the pulse synthesis circuit 15 can be used.

The offset evaluation unit 333 then determines if the calculated offset is within the tolerance range (S17).

This tolerance range is set according to the previous time adjustment stored in the time adjustment storage means 33.

For example, if the previous time adjustment is +0.6 second, meaning that the internal time was advanced 0.6 second, the tolerance range is set to this +0.6 second ±0.1 second. The tolerance range in this case is therefore greater than or equal to +0.5 second and less than or equal to +0.7 second.

If the previous time adjustment was −0.3 second, meaning that the internal time was delayed 0.3 second, the tolerance range is greater than or equal to −0.4 second and less than or equal to −0.2 second.

The value that is used to set the tolerance range is not limited to ±0.1 second as noted above, but is preferably a maximum ±0.5 second. More specifically, the accuracy of the internal time of the timepiece is greatly affected by the temperature characteristic of the reference oscillator 16 (quartz), and timepiece accuracy is very likely different between the summer when the temperature is high and the winter when the temperature is low. However, because the temperature does not change greatly from day to day, the offset of the internal time does change greatly from the time adjustment made the last time the standard time signal was received when the standard time signal is received daily, and the maximum deviation used to set the tolerance range can therefore be set to at most ±0.5 second. If a value greater than ±0.5 second is used, the tolerance range for detecting the offset will be greater than one second and it will not be possible to determine if the internal time is fast or slow. The predetermined margin must therefore be set to at most ±0.5 second or less.

If the time adjustment storage means 33 determines that the offset is within the tolerance range and step S17 returns Yes, the simple time adjustment means 330 tells the reception circuit unit 23 to end reception and the reception process ends (S18).

The seconds information adjustment unit 334 then adjusts the seconds timing of the internal clock (S19) based on the offset calculated by the offset calculation unit 332, and the reception process ends.

However, if step S12 returns No because more than 24 hours have passed since the previous successful reception, or if step S17 returns No because the offset exceeds the tolerance range, the normal, time adjustment means 320 operates to receive the full time code as known from the related art (S20).

The normal time adjustment means 320 also determines if receiving the full time code succeeded (S21). If reception succeeded, the time information updating means 32 adjusts the time (S22). The amount the time is adjusted by the time information updating means 32 is also stored in the time adjustment storage means 33 (S23).

The time adjustment stored by the time adjustment storage means 33 is the amount of adjustment in one day. For example, if reception succeeded three days ago, two days ago step S21 determined that reception failed and the time was not adjusted, but reception succeeded yesterday and the time was adjusted, yesterday's time adjustment corrects the internal clock to account for two days of deviation. In this case the time adjustment made yesterday is divided by two to determine the time adjustment per day.

If reception succeeded three days ago, step S19 adjusted only the seconds timing two days ago, and yesterday reception was successful and the time was adjusted, the time should have been adjusted to the correct time by adjusting the seconds timing, and the time adjustment made yesterday can be stored as the time adjustment per day. Alternatively, the adjustment of the seconds timing two days ago and the time adjustment made yesterday can be added and then divided by two to determine the time adjustment per day.

Because the reception schedule is set to a predetermined time every day (such as 2:00 a.m. daily) in this embodiment of the invention, if the previous time code reception was successful, step S12 will return Yes because the current time is within 24 hours of the last successful reception, and the simple time adjustment means 330 executes a simple time adjustment process (a shortened reception process). On the other hand, if the simple time adjustment process was executed last, more than 24 hours will have passed since the last successful signal reception, and the normal time adjustment means 320 receives the full time code (normal reception process). This embodiment of the invention therefore normally alternates every other day between full time code reception and a shortened reception mode.

Furthermore, if reception fails in step S21, the reception process is normally run again after a predetermined time or at the next scheduled reception time, but if reception fails consecutively for a predetermined number of times, the reception channel can be changed to attempt receiving a different standard time signal.

The first aspect of the invention described above affords the following benefits.

(1) This embodiment of the invention has a normal time adjustment means 320 for receiving the full time code of the standard time signal and a simple time adjustment means 330 that can shorten the reception time, and therefore reduces power consumption.

More specifically, the simple time adjustment means 330 adjusts the second timing of the internal clock based on the offset between the timing of the rising edge of the rectangular wave pulses of the standard time signal occurring at one second intervals and the second timing of the internal time, and can therefore adjust the time with a shortened reception process that receives from 10 to 30 pulses (10 to 30 seconds). This embodiment of the invention can therefore adjust the time in a very short time compared with receiving the full time code to adjust the time, and can therefore greatly reduce power consumption.

(2) The offset evaluation unit 333 sets a tolerance range based on the amount of time adjustment stored in the time adjustment storage means 33, and can therefore accurately detect the offset.

More specifically, when there is an offset between the timing of the rising edges at one-second intervals in the rectangular wave pulses of the standard time signal and the second of the internal time, whether the internal time is slow or fast cannot be conventionally determined.

However, by focusing on the offset of the internal time in a radio-controlled timepiece normally always being in the same direction (fast or slow) and setting a tolerance range based on how much the time was adjusted the last time reception was successful, the present invention can determine whether the offset of the internal time to the standard time signal is fast or slow. The invention can therefore correctly determine the offset between the internal time and the received time code, and can correctly adjust the internal time.

(3) The pulse timing detection unit 331 detects and obtains the average timing of the rising edge of the rectangular wave pulses plural times (10 to 30 times approximately), can therefore reduce error in the detected timing of the falling edges due to noise, and can accurately detect the timing of the rising edges of the rectangular wave pulses. As a result, the offset of the internal time can also be accurately detected and corrected.

(4) Furthermore, because error in even a single bit is not allowed when adjusting the time based on a full time code, a signal with a high S/N ratio is needed. However, because the simple time adjustment means 330 only needs to detect the timing of the rising edges of plural pulses in order to adjust the time, the time can still be adjusted using a weak signal with a low S/N ratio, and the reception range is therefore greatly increased.

Second Embodiment

A radio-controlled timepiece 1 according to a second embodiment of the invention is described next.

Identical or functionally similar parts in this and the previous embodiment are identified by like reference numerals, and further description thereof is omitted or abbreviated.

Figure 10:
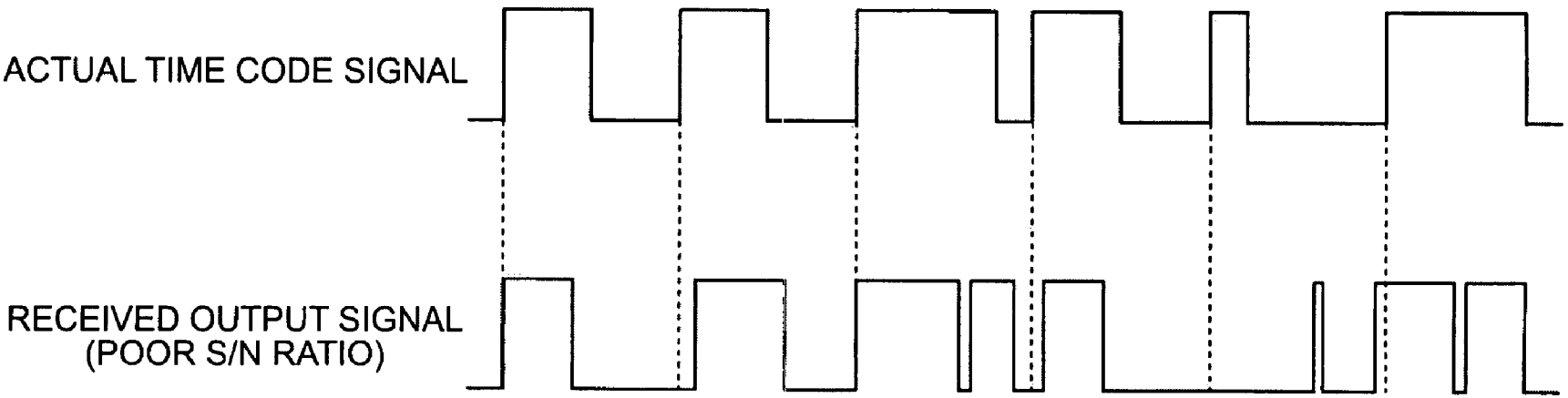
FIG. 10 shows an example of the reception output signal in a second embodiment of the invention.

The radio-controlled timepiece 1 according to this second embodiment improves the pulse timing detection unit 331 so that the rising edge timing of the rectangular wave pulses can be accurately detected even when the reception signal output by the reception circuit unit 23 has a low S/N ratio and contains noise as shown in FIG. 10.

When the S/N ratio is low as shown in FIG. 10, the signal contains noise and the pulse width is narrower than in the actual time code. In the normal JJY time code the narrowest pulse width is 200 msec as shown in FIG. 5. As a result, any pulses with a width shorter than 200 msec can be dropped because they represent noise.

Figure 11:
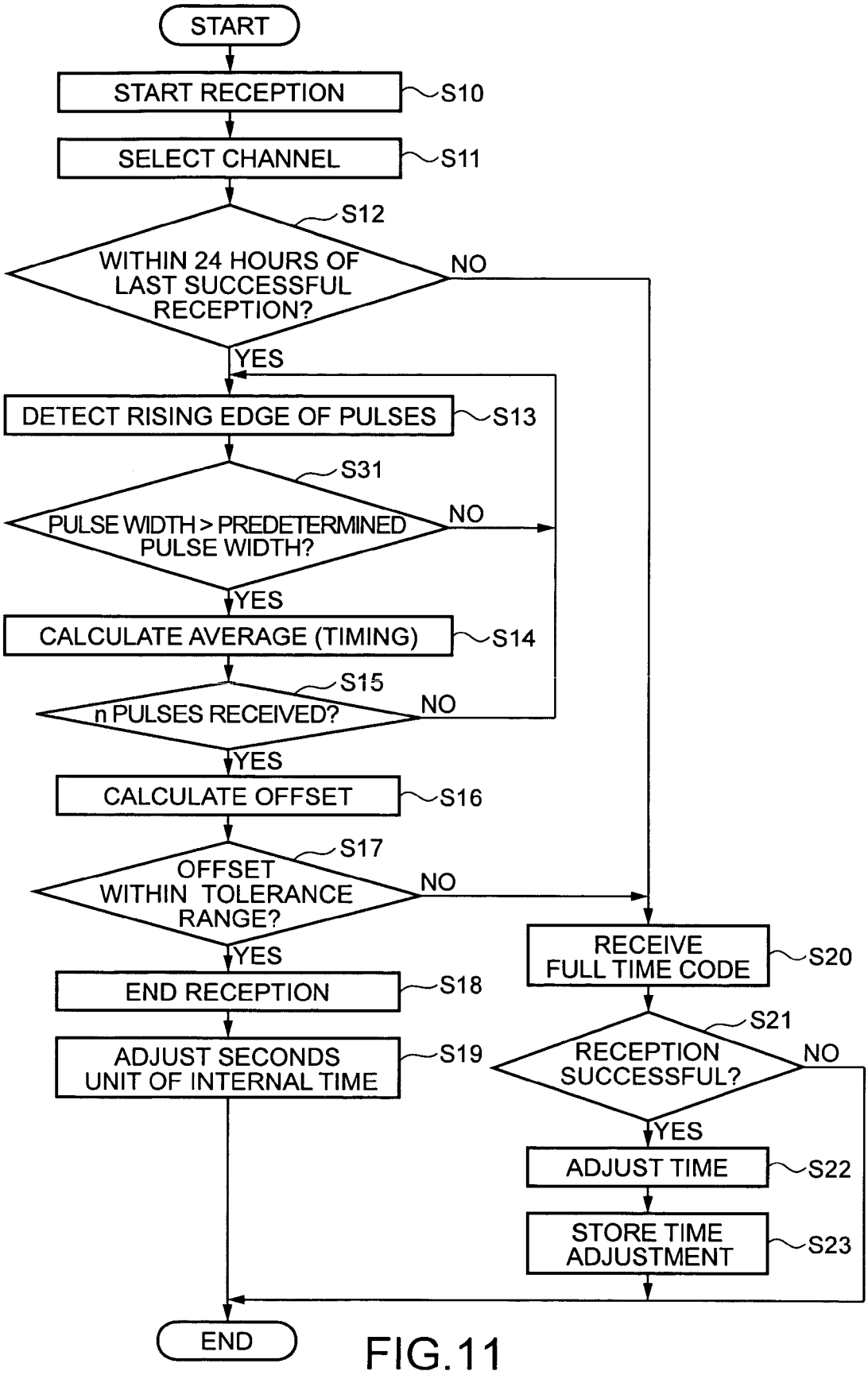
FIG. 11 is a flow chart of the reception process in a second embodiment of the invention.

After detecting the rising edges of the rectangular wave pulses in step S13, this embodiment of the invention compares the pulse width with a predetermined threshold level (such as 100 msec) (S31) as shown in FIG. 11. If the pulse width is greater than this threshold level and S31 returns Yes, the average calculation step S14 executes. If the pulse width is less than or equal to this threshold level and S31 returns No, the timing of the rising edge of that pulse is ignored and not used to calculate the average, and rising edge detection continues.

The pulse width of the rectangular wave pulses can be detected by sampling signals from the reception circuit unit 23, determining if the signals are a 1 or a 0, and determining the pulse width. For example, if the sampling period is 10 msec (100 Hz) from 31.3 msec (32 Hz) and the sampled pulse level (HIGH) is not detected plural times consecutively, the sampled pulses are dropped as invalid. For example, if the sampling period is 10 msec and the pulse level of the sampled pulse remains HIGH for ten consecutive sampling periods, a HIGH pulse is known to continue for 100 msec and the pulse width is known to be 100 msec or greater.

Furthermore, because the pulse width of the normal signal is known, a method of starting a timer from the rising edge of a pulse and measuring the time to the falling edge to determine the pulse width, and discarding the detected falling edge and continuing measurement if the timer output is less than or equal to a predetermined value, can be used.

Figure 12:
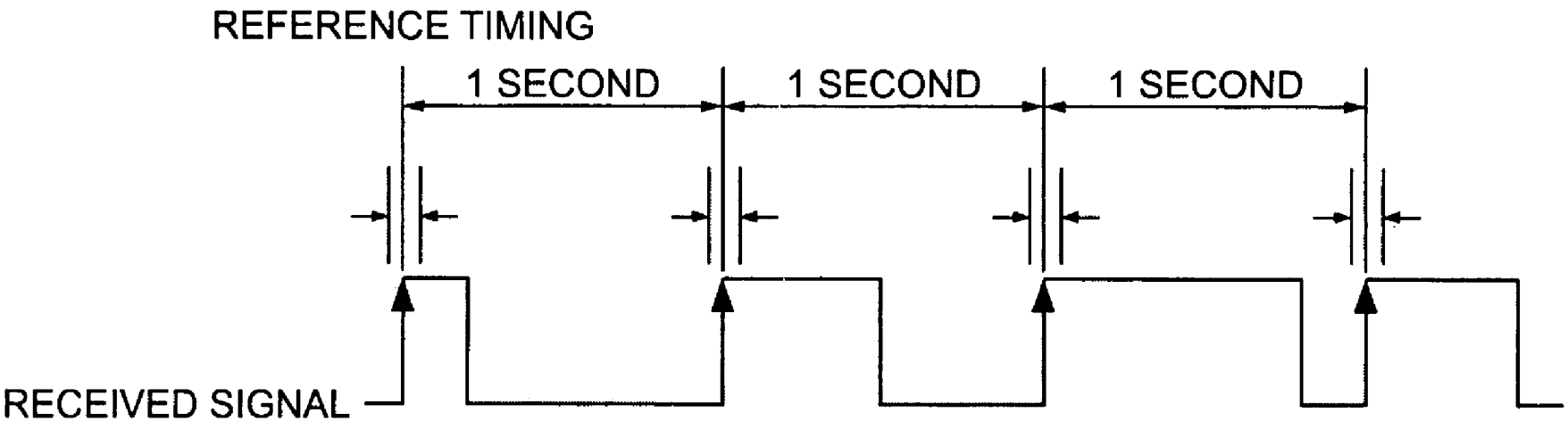
FIG. 12 describes detecting the timing of the rising edge in the second embodiment of the invention.

Instead of detecting rising edges caused by noise, it is also possible to detect only the rising edge of rectangular wave pulses at regular one-second intervals by determining whether the rising edge of the next pulse is detected within a predetermined range (such as ±31 msec) of the one-second interval after the rising edge of a detected pulse as shown in FIG. 12.

This second embodiment of the invention thus affords the same benefits as the first embodiment of the invention.

In addition, this embodiment can also detect only the rising edges of the rectangular wave pulses at one-second intervals and thereby reduce the effects of noise when the S/N ratio is low and noise is mixed with the rectangular wave pulses. As a result, the timing of the rising edges of the signal pulses can be detected more accurately, and the time adjustment operation of the simple time adjustment means 330 can be made more precise.

The present invention is not limited to the foregoing embodiments, and can be modified and improved in various ways without departing from the scope of the accompanying claims, and all such variations are included in the scope of the present invention.

For example, the simple time adjustment means 330 operates if the time is adjusted within 24 hours of the last successful time code reception, the full time code is received at least once every other day, and shortened reception by the simple time adjustment means 330 does not occur on consecutive days, but the shortened reception mode could be used on plural consecutive days.

However, in order to improve the accuracy of the internal time, the full time code is preferably set to be received at least once a week so that the full time code is received next after six consecutive short reception operations.

The rising edge timing of each pulse is detected in step S13 while the average timing is calculated in step S14 above. Alternatively, the evaluation step S15 could follow step S13 so that the averaging step S14 executes after the edge of n pulses is detected.

Yet further, the full time code is received if the offset is not within the tolerance range in step S17 above. Alternatively, however, receiving the full time code and adjusting the time can be skipped and the reception process S2 can be executed at the next scheduled reception time. For example, if the signal level (strength) of the received rectangular wave pulse is detected and is low, there could be error in the timing of the rising edge of the pulse due to signal noise and the offset could therefore be outside the range of tolerance. The likelihood that the correct time code cannot be received is therefore high even if the full time code is received under such conditions. Delaying the signal reception step S2 until the next scheduled reception time in this situation eliminates unnecessary reception operations and therefore helps conserve power.

The reference timing of each pulse is when the pulse rises from LOW to HIGH in the above embodiments, but depending on the type of standard time signal and the arrangement of the reception circuit unit 23, the timing of the falling edge of each pulse can be used as the reference timing if each pulse of the decoded reception signal falls at a one second interval.

More specifically, because the signal level changes when the rectangular wave pulses rise or fall at a one second interval, the timing at which the signal level changes can be detected by the pulse timing detection unit 331 and used as the reference timing.

Furthermore, the movement is stopped during signal reception in these embodiments, but the movement does not need to be stopped. More particularly, because the simple time adjustment process of the simple time adjustment means 330 is more resistant to the effects of noise, the time can still be adjusted even if driving the second hand or minute hand affects signal reception.

Yet further, the method of the invention is effective whether the reception means is activated and starts receiving automatically according to a reception schedule (scheduled reception) or whether the reception means is activated and starts receiving in response to a specific operation of the external operating member by the user (manual reception).

The drive control means 3, time data storage circuit unit 24, counter means 6, and other circuits and means are not limited to a hardware arrangement of logic devices and other devices, and can be rendered by providing a computer having a CPU and memory in the timepiece 1 and implementing these circuits and means as steps of a specific software program that is run by the computer.

For example, a CPU and memory can be disposed in the radio-controlled timepiece 1 and caused to function as a computer. A specific control program and data can be installed in memory by way of the Internet or other communication means, CD-ROM, memory card, or other recording medium, and the CPU can run the installed program to render the drive control means 3, time data storage circuit unit 24, and other means described above.

A memory card or CD-ROM, for example, can be directly inserted to the timepiece 1, or a device for reading the recording medium can be connected to the timepiece 1 in order to install a particular program in the radio-controlled timepiece 1. The program can also be installed by connecting a LAN cable or telephone line, for example, to the radio-controlled timepiece 1 and installing the program by electronic communication. Further alternatively, the program can be installed by wireless communication because the radio-controlled timepiece 1 has an antenna 21.

If a control program provided by such recording media or communications means such as the Internet is incorporated into the radio-controlled timepiece 1, the functions of the invention can be implemented by simply changing the program, thereby enabling selectively installing the control program prior to factory shipping or as desired by the user. This enables manufacturing radio-controlled timepieces 1 featuring different control modes by simply changing the control program, thus facilitating the use of common parts in different products and greatly reducing the cost of manufacturing a variety of different models.

The functions of the radio-controlled timepiece, particularly the timekeeping means, reception means, and time adjustment means, are not limited to the arrangements described above and the means of a radio-controlled timepiece as known from the literature can be used.

The number of different signals and countries (regions) that can be selected by the radio-controlled timepiece 1 can also be set desirably according to the particular implementation.

The radio-controlled timepiece 1 according to the present invention is not limited to an analog timepiece, and could be a digital timepiece or a timepiece that combines an analog movement with a digital LCD unit.

The radio-controlled timepiece 1 could be any of various kinds of timepieces, including a portable timepiece such as a wristwatch or pocket watch, or a stationary timepiece such as a wall clock or mantle clock.

A radio-controlled timepiece according to the present invention is also not limited to stand-alone timepieces and can also be incorporated in other devices such as video decks, televisions, cell phones, personal computers, electronic toys, and timers. More particularly, the invention improves the accuracy of the displayed time and reduces power consumption, and is therefore particularly suited to radio-controlled timepieces that are built in to portable devices that do not normally receive power from a commercial power supply.

The present invention has been described in connection with preferred embodiments thereof with reference to the accompanying drawings, and it will be obvious that various modifications will be apparent to those skilled in the art. Such variations are included within the scope of the present invention as defined by the appended claims, unless they depart therefrom.

The entire disclosure of Japanese Patent Application Nos: 2005-366548, filed Dec. 20, 2005 and 2006-233287, filed Aug. 30, 2006 are expressly incorporated by reference herein.

What is claimed is:

1. A radio-controlled timepiece comprising:

a reception means for receiving time information modulated by rectangular wave pulses;

a reception control means for controlling driving the reception means based on a preset schedule;

a time information updating means for updating internal time information, based on the time information received by the reception means;

a time adjustment storage means for storing how much the internal time information was adjusted by the time information updating means; and a time display means for displaying the time based on the internal time information;

wherein the rectangular wave pulses have a rising edge or falling edge occurring at a one-second interval and have a pulse width that when measured from a reference timing that is the timing of the rising edge or falling edge of a pulse to the falling edge of a pulse that rose or the rising edge of a pulse that fell is less than the one-second interval and is one of a plurality of lengths;

the reception control means comprises a simple time adjustment means that is driven when the reception means is driven within a predetermined time of the last successful signal reception, and a normal time adjustment means that is driven when the reception means is driven after a predetermined time since the last successful signal reception has passed;

the normal time adjustment means drives the reception means for the time required to receive a full time code, and adjusts the internal time information by means of the time information updating means when time code reception is successful; and the simple time adjustment means comprises a pulse timing detection unit for driving the reception means for a shorter time than when receiving a full time code and detecting the reference timing of the rectangular wave pulses in the time information, an offset calculation unit for calculating the offset between the reference timing of the rectangular wave pulses detected by the pulse timing detection unit and the timing of seconds in the internal time information, an offset evaluation unit for determining if the offset calculated by the offset calculation unit is within a tolerance range set based on the previous time adjustment stored in the time adjustment storage means, and a seconds information adjustment unit for adjusting seconds information of the internal time information based on the offset when the offset evaluation unit determines the offset is within the tolerance range.

2. The radio-controlled timepiece described in claim 1, wherein the simple time adjustment means drives the normal time adjustment means to receive a full time code when the offset evaluation unit determines the offset is outside the tolerance range.

3. The radio-controlled timepiece described in claim 1, wherein:

the time adjustment storage means stores the time adjustment as a positive value when the internal time information is advanced for adjustment, and stores the time adjustment as a negative value when the internal time information is delayed for adjustment; and the offset calculation means detects the time from the reference timing of the rectangular wave pulse to the timing of the next second in the internal time information as a positive offset value when the time adjustment is positive, and detects the time from the timing of the second in the internal time information to the reference timing of the next rectangular wave pulse as a negative offset value when the time adjustment is negative.

4. The radio-controlled timepiece described in claim 1, wherein:

the reception control means is set to a schedule for driving the reception means at a one-day interval; and the offset evaluation unit converts the time adjustment stored by the time adjustment storage means to a time adjustment per day value, sets the tolerance range to a specific range bracketing this time adjustment per day value, and sets the specific range to less than ±0.5 second.

5. The radio-controlled timepiece described in claim 1, wherein the pulse timing detection unit detects a predetermined number of rising edges or falling edges of the rectangular wave pulses and calculates the average timing to set the reference timing of the rectangular wave pulses.

6. The radio-controlled timepiece described in claim 5, wherein when calculating the average timing the pulse timing detection unit ignores the rising edge or falling edge data of rectangular wave pulses in the received time information when the pulse width is less than a predetermined value.

7. A time adjustment method for a radio-controlled timepiece having a reception means for receiving time information modulated by rectangular wave pulses, a reception control means for controlling driving the reception means based on a preset schedule, a time information updating means for updating internal time information based on the time information received by the reception means, a time adjustment storage means for storing how much the internal time information was adjusted by the time information updating means, and a time display means for displaying the time based on the internal time information, wherein the rectangular wave pulses have a rising edge or falling edge occurring at a one-second interval and have a pulse width that when measured from a reference timing that is the timing of the rising edge or falling edge of a pulse to the falling edge of a pulse that rose or the rising edge of a pulse that fell is less than the one-second interval and is one of a plurality of lengths;

the reception control method comprises a simple time adjustment step that executes when the reception means is driven within a predetermined time of the last successful signal reception; and a normal time adjustment step that executes when the reception means is driven after a predetermined time since the last successful signal reception has passed;

the normal time adjustment step drives the reception means for the time required to receive a full time code, and adjusts the internal time information by means of the time information updating means when time code reception is successful; and the simple time adjustment step comprises a pulse timing detection step for driving the reception means for a shorter time than when receiving a full time code and detecting the reference timing of the rectangular wave pulses in the time information, an offset calculation step for calculating the offset between the reference timing of the rectangular wave pulses detected by the pulse timing detection step and the timing of seconds in the internal time information, an offset evaluation step for determining if the offset calculated by the offset calculation step is within a tolerance range set based on the previous time adjustment stored in the time adjustment storage means, and a seconds information adjustment step for adjusting seconds information of the internal time information based on the offset when the offset evaluation step determines the offset is within the tolerance range.

* * * * *